US005450633A

United States Patent [19]

Semmler

[11] Patent Number: 5,450,633

[45] Date of Patent: Sep. 19, 1995

[54] TOILET SEAT

[76] Inventor: Axel Semmler, Kannenhofer Weg 100, D-41066 Mönchengladbach, Germany

[21] Appl. No.: 248,967

[22] Filed: May 25, 1994

[30] Foreign Application Priority Data

Jul. 9, 1993 [DE] Germany ..... 93 10 259.3 U

[51] Int. Cl.[6] ..... A47K 13/12

[52] U.S. Cl. ..... 4/236; 4/240; 16/379

[58] Field of Search ..... 4/236, 240; 16/378, 16/379

[56] References Cited

U.S. PATENT DOCUMENTS

| | | | |
|---|---|---|---|
| 1,385,800 | 7/1921 | Soss | 16/379 X |
| 1,676,865 | 7/1928 | Mangialetti | 16/379 X |
| 1,718,482 | 6/1929 | Myers | 4/236 X |
| 1,839,452 | 1/1932 | Thompson | 4/240 X |
| 3,790,969 | 2/1974 | Waldon | 4/236 |

FOREIGN PATENT DOCUMENTS

| | | | |
|---|---|---|---|
| 0459435 | 5/1928 | Germany | 4/236 |
| 3016794 | 11/1981 | Germany | 4/240 |
| 0161014 | 6/1933 | Switzerland | 4/240 |
| 0454837 | 10/1936 | United Kingdom | 4/240 |

*Primary Examiner*—Robert M. Fetsuga
*Attorney, Agent, or Firm*—Mason, Kolehmainen, Rathburn & Wyss

[57] ABSTRACT

A toilet seat, more especially for a toilet with an upwardly extending flush cistern on the rearward region thereof, has an upwardly pivotable seat ring, possibly an upwardly pivotable lid, and a back plate portion which is fixedly connected to the seat ring extending therefrom on the side of its pivot axis which is remote from the the seat ring, whereby the back plate portion is pivotable with the seat ring. The spacing in respect of height of the pivot axis of the seat ring from the underside thereof at least substantially corresponds to the spacing between that pivot axis and the rearward end of the back plate portion.

6 Claims, 1 Drawing Sheet

TOILET SEAT

BACKGROUND OF THE INVENTION

A toilet seat typically comprises a seat ring which can be pivoted between a raised and a lower position, possibly a lid which can also be pivoted between a raised and lowered position, and a fixing arrangement for mounting the seat ring and possibly the lid on a toilet pan or bowl in a rearward region thereof.

The seat ring and the lid if provided occupy a stable position, in their condition of being pivoted upwardly, when the angle between their horizontal position and the upwardly pivoted position is greater than 90°. In the case of typical toilet seat assemblies the mounting eye members for pivotably mounting the seat and possibly the lid are respectively disposed in the region of the rearward end of the assembly. That means that, in order to afford a stable raised position, the arrangement must be so designed that, on the side of the pivot axis which is opposite to the seat ring, there is in an upward direction sufficient space for the seat ring and possibly the lid if provided to be pivoted into the stable raised position. In many situations however that space does not exist, for example and more particularly if the toilet has a flush tank or cistern which extends upwardly from the upper edge of the toilet pan or bowl, in the rearward end region thereof. The presence of the flush tank at that position would prevent the seat from moving beyond the 90° position in going from the lowered position to the raised position. Accordingly, in order also to afford a stable raised position in such situations, the pivot axis mounting the seat ring is displaced forwardly in a horizontal direction by a suitable distance so that the angle between the horizontal or lowered position of the seat ring and the raised position thereof is once again an obtuse angle, with the seat ring thus 'leaning against' the flush tank. A design configuration which is often adopted in such cases is to employ a plate-like portion which can be referred to herein as the back plate portion and which adjoins the rearward end of the seat ring in the horizontal position of the seat ring and the lid if provided, thereby filling the space between the rearward end of the seat ring and the rearward end of the toilet pan. The back plate portion thus has the effect of moving forwardly the pivot axis about which the seat ring pivots and for that purpose is fixedly mounted to the toilet pan.

The production of a back plate portion of that kind, which generally comprises plastic material, is relatively expensive as adjustable or displaceable fixing devices usually have to be provided, having regard to the existence of toilet pans of different configurations. Accordingly such toilet seat assemblies are therefore more expensive to produce than a toilet seat assembly which does not have a back plate portion.

A further problem which may arise is that it is difficult to produce the back plate portion and the other parts of the toilet seat in exactly the seine color, in particular when for example the seat ring essentially consists of wood while the back plate portion is in the form of a plastic member. A further disadvantage is that toilet seats with a back plate portion are in principle unsatisfactory from the point of view of visual attraction as the transitional region between the rearward end of the seat ring and the front edge of the back plate portion is always visible.

SUMMARY OF THE INVENTION

An object of the present invention is to provide a toilet seat which can be used more especially for a toilet having an upwardly extending flush tank in the rearward region thereof, which seat involves satisfactory production costs and is also visually satisfying.

Another object of the present invention is to provide a toilet seat incorporating a back plate portion, in which color differences within the arrangement can be at least substantially avoided.

In accordance with the present invention the foregoing and other objects are achieved by a toilet seat which is suitable more especially for toilets with an upwardly extending cistern or flush tank which can be fitted thereon in the rearward region thereof, comprising an upwardly pivotable seat ring and possibly an upwardly pivotable lid, together with a back plate means which adjoins the seat ring extending therefrom on the side of the pivot mounting axis, which is remote from the seat ring. The back plate means is fixedly connected to the seat ring, and is adapted to be pivotable therewith. The spacing in respect of height of said pivot axis from the underside of the seat ring at least substantially corresponds to the spacing between the pivot axis and the rearward end edge of the back plate means, namely the edge remote from the seat ring.

As will be seen in greater detail from the description hereinafter of a preferred embodiment of the invention, the toilet seat in accordance with the principles of the invention enjoys the advantage that the fact that the pivot axis is disposed at a higher position, in comparison with prior toilet seats in which the pivot axis is disposed approximately at the level of the seating plane of the seat ring, affords the possibility of joining the back plate means to the seat ring and arranging for that assembly to be pivotable. As a result of the pivot axis being raised, upon upward pivotal movement of the seat ring corresponding pivotal movement is possible in a downward direction, in respect of the region of the back plate means which is between the pivot axis and the rearward end edge of the back plate means. A further advantage of the toilet seat assembly according to the invention is that the seat ring and the back plate means can be produced in one piece and thus comparatively inexpensively. That then also affords the advantage that both those parts can be made from the same material, thereby at least minimizing and usually eliminating color differences therebetween.

In accordance with a preferred feature of the invention the back plate means which is generally in the form of a back plate portion comprises a shaped or molded body which at its underside forms a hollow or trough-like configuration. The shaped body has an upper boundary which extends upwardly beyond the seating plane, with downwardly extending side portions. The pivot axis is preferably disposed in the hollow configuration beneath the upper boundary of the shaped body and above the seating plane of the seat ring on mounting bracket members which can be fixed to the toilet pan. In its rearward lower end region the shaped body is of an external contour providing a rounded configuration whose radius corresponds at most to the spacing in respect of height of the pivot axis. That permits the shaped body which provides the back plate means to be of a configuration such as to afford structural solidity, while at the same time guaranteeing the required free radius of pivotal movement for the shaped body forming the back plate means.

If the toilet seat additionally has a lid, in accordance with a preferred feature of the invention the lid is pivotably mounted on pivot mounting trunnions of mounting bracket members, by means of pivotal brackets each having a radially extending portion and a curved portion, wherein each curved portion is fixedly connected with one end to the lid and passes through a respective opening in the rearward region of the seat ring or the shaped body of the back plate portion, while the radially extending portion is connected to the respective other end of the curved portion, and is mounted at its free end pivotably about the pivot axis. From a visual point of view it is particularly advantageous if the configuration is such that, in the lowered condition, the upper edge of the upper boundary of the shaped body forming the back plate means and the upper edge of the lid each lie in the same plane.

Further objects, features and advantages of the invention will be apparent from the following description of a preferred embodiment of the invention.

DESCRIPTION OF THE PREFERRED EMBODIMENT

Figure 1:
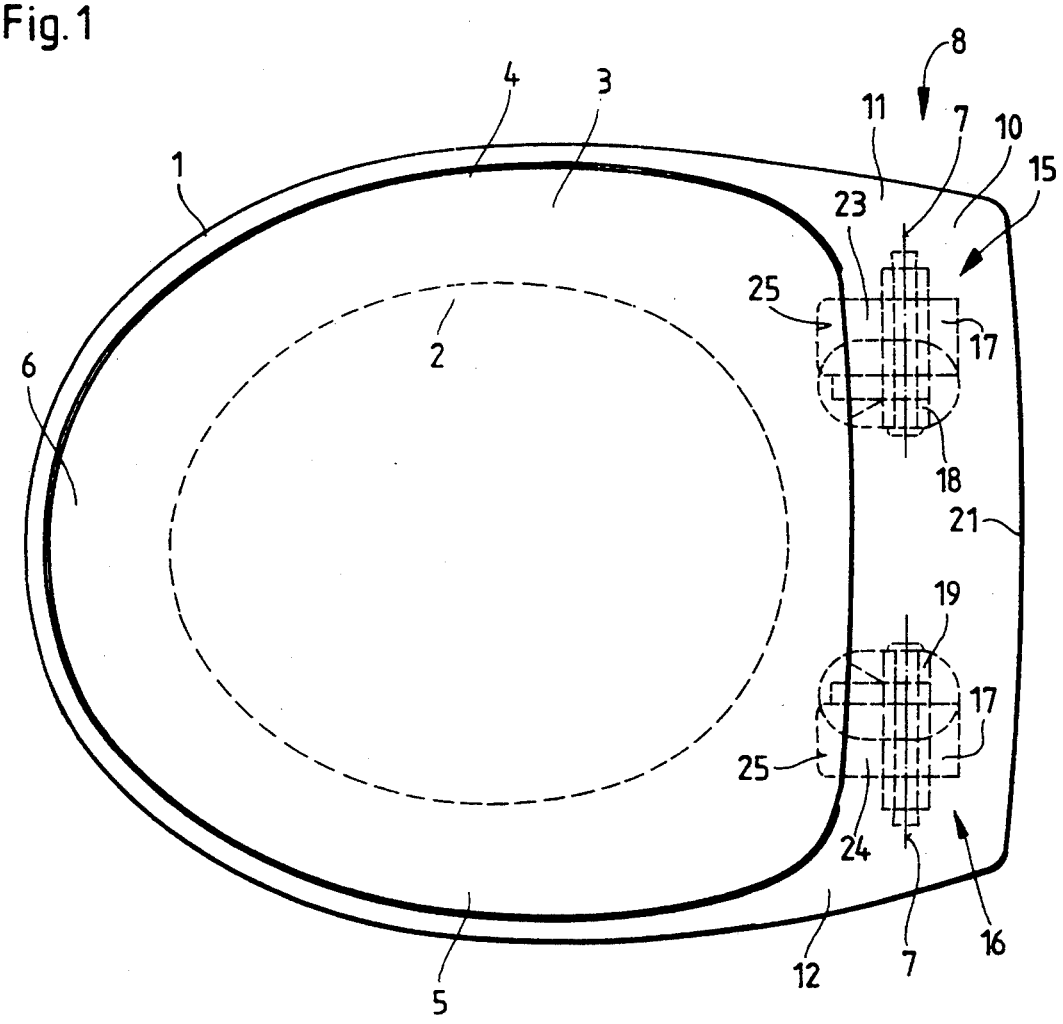
FIG. 1 is a plan view of a toilet seat according to the invention.
Figure 2:
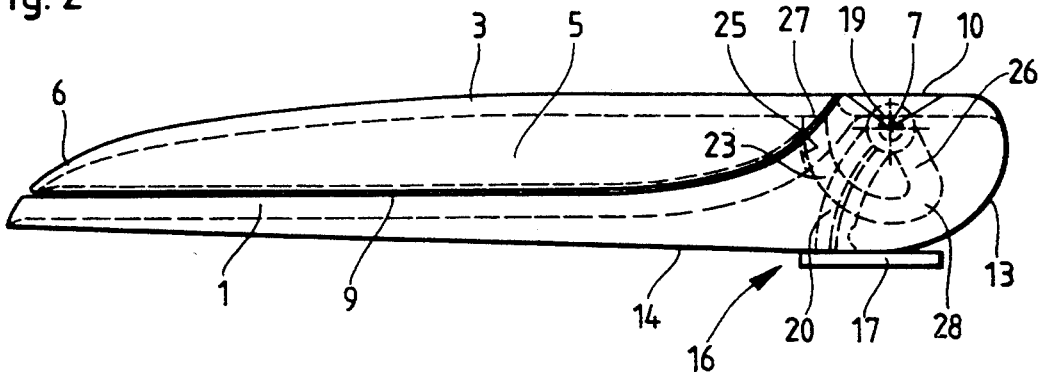
FIG. 2 is a side view of the toilet seat shown in FIG. 1.

Referring generally to the drawing, a toilet seat in accordance with the invention as diagrammatically shown in the drawing comprises a seat ring generally identified by reference numeral 1, with an inner opening 2 therethrough, and an optional lid 3, the side edges 4 and 5 and the front edge 6 of which are of such a configuration as to be curved downwardly towards the seat ring. Both the seat ring 1 and also the lid 3 are designed to be pivotable about a pivot axis diagrammatically indicated at 7, between an at least substantially horizontal lowered position as shown in FIG. 2, and a raised position. The seat ring 1 is formed integrally with a portion referred to herein as the back plate portion generally identified by reference numeral 8. The back plate portion 8 is in the form of a shaped or molded body with an upper boundary 10 which extends upwardly beyond the seat plane 9 of the seat ring 1. The upper boundary 10 has downwardly extending side portions 11 and 12. The overall configuration is such that, in the closed position of the lid 3, the upper boundary 10 of the shaped body forming the back plate portion 8 and the top side of the lid 3 are disposed at least substantially in one plane and the lateral boundaries or side edges 4 and 5 of the lid are aligned with the downwardly extending side portions 11 and 12 of the back plate portion 8.

In its rearward end region the back plate portion 8 is of a contour that provides a rounded configuration as indicated at 13 in FIG. 2, the radius of which corresponds at most to the spacing in respect of height between the pivot axis and the underside 14 of the seat ring 1.

For the purposes of mounting the toilet seat on a toilet pan or bowl (not shown), the arrangement has diagrammatically illustrated mounting brackets 15 and 16 which can be mounted above the rearward upper end region of the toilet pan or bowl in the usual manner by means of screws (not shown) passing through appropriate openings in the toilet pan or bowl. The mounting brackets 15 and 16 each comprise a base plate 17 and a mounting bracket portion 18 and 19 respectively, for forming the pivot axis 7. The mounting bracket portions 18 and 19 are mounted to the back plate portion 8 and disposed above the lower edge 14 of the seat ring 1 by way of upwardly extending bracket portions 20. The spacing in respect of height of the pivot axis 7 from the underside 14 of the seat ring 1 corresponds to the spacing between the pivot axis 7 and the rearward end edge 21 of the back plate portion 8 which is formed integrally with the seat ring 1. As the radius of the rounded contour portion 13 also corresponds to the above-indicated spacing in respect of height, the seat ring 1 can be readily pivoted upwardly from the position shown in FIG. 2 by pivotal movement about the pivot axis 7, more specifically to such an angle as to define an obtuse angle relative to the seating plane when the seat ring 1 is in the lowered position, thereby affording a stable raised or open position for the seat ring 1.

For pivotably mounting the lid 3 the toilet seat arrangement according to the invention has pivot mounting brackets 23 and 24 which each pass through a respective opening 25 in the transitional region between the rearward end of the seat ring 1 and the back plate portion 8. The pivot mounting brackets 23 and 24 each comprise a curved portion and a radial portion 26; that is to say portion which extends radially relative to the pivot axis 7 about which the pivot mounting brackets 23 and 24 are pivotable, as will be described in greater detail hereinafter. The curved portion is connected by one end as indicated at 27 to the lid 3 while its other end 28 is connected to the radial portion 26. The free end of the radial portion 26 is in turn pivotable about the pivot axis 7 on the respective pivot trunnion afforded by the respective mounting bracket portions 18 and 19. The radius of the curved portion of each of the pivot mounting brackets is so selected that it is possible for the lid 3 to be pivoted upwardly or for the curved portions of the pivot mounting brackets to be pivoted out of the openings 25.

As will be readily apparent the lid 3 can also be pivoted upwardly to such an extent that it can move into a stable raised position. Likewise the lid 3 and the seat ring 1 can also be pivoted simultaneously upwardly about the pivot axis 7 into a stable position.

It will be appreciated that the above-described embodiment of the present invention has been set forth solely by way of example and illustration thereof and that various modifications and alterations may be made therein without thereby departing from the spirit and scope of the invention.

What is claimed is:

1. A toilet seat assembly comprising: mounting means having a base member for mounting said toilet seat assembly on a toilet pan; a toilet seat having a seat ring portion and a back plate portion, said seat ring portion extending from a front edge of said toilet seat toward said back plate portion and said back plate portion extending from said seat ring portion to a rear edge of said toilet seat; pivotal mounting means on said mounting means for mounting said toilet seat including said seat ring portion and said back plate portion pivotably about a pivot axis spaced from said base member and said rear edge so that said toilet seat is pivotal downwardly to a lowered seating position and upwardly to a raised position, said pivotal mounting means being disposed between said seat ring portion and said rear edge and said base member being disposed between said front and rear edges of said toilet seat; the distance of said pivot axis from said base member being at least substantially corresponding to the distance between said pivot axis and said rear edge of said toilet seat; a lid mounted to said toilet seat assembly; lid pivot bracket means for pivotally mounting said lid about said pivot axis, said lid pivot bracket means having a radially extending first portion and a second curved portion, said second curved portion being fixedly mounted to the lid and extending to said radially extending first portion and said radially extending first portion extends from said second curved portion to said pivotal mounting means so as to be mounted pivotally to said pivotal mounting means, and wherein said toilet seat has an opening through which said second curved portion is adapted to extend.

2. A toilet seat assembly as set forth in claim 1 wherein said pivotal mounting means includes a plurality of pivot trunnions.

3. A toilet seat assembly as set forth in claim 2 wherein said toilet seat includes a transitional region between said seat ring portion and said back plate portion, and wherein said opening extends through said transitional region.

4. A toilet seat assembly as set forth in claim 1 wherein said back plate portion comprises a shaped body having an underside to which said pivotal mounting means is mounted, the shaped body further having an upper boundary extending upwardly beyond a seating plane of said seat ring portion and having downwardly extending side portions, wherein said pivot axis is disposed beneath the upper boundary of the shaped body and above the seating plane of the seat ring portion, and wherein the external contour of the shaped body has a rearward lower end region providing a rounded configuration of a radius which corresponds at most to said distance of said pivot axis from said base member.

5. A toilet seat assembly as set forth in claim 1 wherein said pivotal mounting means is mounted to said back plate portion of said toilet seat, thereby said pivotal mounting means is at least substantially concealed by said back plate portion when said toilet seat is in said lowered seating position.

6. A toilet seat assembly as set forth in claim 1 wherein said lid is pivotal between a lowered position and a raised position.

* * * * *